US005355605A

United States Patent [19]

Kim

[11] Patent Number: 5,355,605

[45] Date of Patent: Oct. 18, 1994

[54] DISPLAY DEVICE WITH SHEET MATERIAL SURFACE AND STRESSED FRAME

[76] Inventor: Ki I. Kim, 826 S. Berendo St., Los Angeles, Calif. 90005

[21] Appl. No.: 976,475

[22] Filed: Nov. 16, 1992

[51] Int. Cl.[5] ..... G09F 17/00

[52] U.S. Cl. ..... 40/603; 126/684; 38/102.1; 38/102.91; 101/127.1; 160/354

[58] Field of Search ..... 160/354, 371, 378; 126/684; 40/603; 209/401, 403; 84/411 R, 414, 416, 411 A, 420; 446/450, 236; 428/35.9, 36.91; 359/847; 38/102.1, 102.91; 101/127.1, 128, 128.1; 264/291, 292

[56] References Cited

U.S. PATENT DOCUMENTS

| | | | |
|---|---|---|---|
| 4,466,423 | 8/1984 | Dolan et al. | 126/684 |
| 4,511,215 | 4/1985 | Butler | 359/847 |
| 4,620,382 | 11/1986 | Sallis | 38/102.91 X |
| 4,635,388 | 1/1987 | Bussard | 40/603 X |
| 4,709,928 | 12/1987 | Willingham | 273/309 |
| 4,744,898 | 5/1988 | Bailey | 209/403 X |
| 4,832,652 | 5/1989 | Matsuyama | 446/397 |

FOREIGN PATENT DOCUMENTS

| | | | |
|---|---|---|---|
| 0132305 | 1/1985 | European Pat. Off. | 40/603 |

*Primary Examiner*—Andrew M. Falik
*Attorney, Agent, or Firm*—Boniard I. Brown

[57] ABSTRACT

A display device is formed of thin plastic sheet material extending about a peripheral frame. The frame is formed of a relatively stiff annular core element encapsulated within a resilient foam sheath or shell. In attaching the plastic sheet to the annular frame, edge areas of the sheet are wrapped about the surface of the rubber shell so that the shell is deformed inwardly toward the frame central axis, whereby the deformed shell exerts outward force on the plastic sheet to prevent or remove wrinkling of the sheet. The display device may be suspended, as from a cord or a button on a garment of a person.

13 Claims, 2 Drawing Sheets

DISPLAY DEVICE WITH SHEET MATERIAL SURFACE AND STRESSED FRAME

BACKGROUND OF THE INVENTION

1. Field of the Invention

The present invention relates to a display device comprising a plastic sheet of material stretched taut across an annular frame.

2. Prior Developments

U.S. Pat. No. 4,709,928 to Willingham discloses a circular game board formed by an annular circular frame and a sheet of flexible material, said flexible sheet having edge areas thereof secured to the frame by means of an annular sleeve. The frame is formed of a material having a spring characteristic whereby the frame tends to assume a circular hoop-like configuration. The sheet of flexible material can be leather or plastic.

U.S. Pat. No. 4,832,652 to Matsuyama shows and describes a circular foldable toy comprising an annular hoop-like frame, and a sheet of material stretched across the frame. The frame is described as a continuous metal or plastic leaf spring having elasticity and some rigidity. The sheet of material is described as a film made of vinyl chloride or nylon. The patentee indicates that the flexible sheet may have printed indicia thereon, e.g., a picture or lettering.

The present invention relates to a poster which, in a preferred form, comprises an annular circular frame, and a thin plastic sheet stretched taut across the frame. One or both surfaces of the sheet may have indicia thereon, whereby the poster can be used as a sign or a placard. The poster has a variety of uses. It may be used in political campaigns or in political conventions to promote a political candidate or a political cause. A poster having a relatively large diameter, e.g., twenty inches, may be hung from an overhead support or held in a person's hand for waving or movement above the person's head. A poster having a smaller diameter, e.g., seven inches or less, may be attached to a person's coat or shirt to be visible to other persons.

Devices according to the present invention are adapted for other uses. The plastic sheet surface can be used as a writing surface in the nature of a portable blackboard. Various types of pens and "magic" markers have been developed for writing on plastic surfaces.

Plastic sheet materials are well suited for use in signs or posters because of their smooth lustrous surfaces that accept printing inks without running or spreading, and the indicia applied are sharp and distinct. However, plastic sheet materials must be constrained against flexing and wrinkling in order to prevent distortion and design tenuity of printed indicia. The present invention maintains the plastic sheet in a flat, taut condition by maintaining the sheet stretched across a frame.

It has been found in practice that temperature changes and humidity changes can adversely affect the tautness of the sheet on the mounting frame, especially when the sheet-frame assembly is folded during storage, as in the general manner described in the above-mentioned patents, Nos. 4,709,928 and 4,832,652. The adverse effect is a wrinkling or waviness in the plastic sheet, such that the printed indicia becomes distorted and/or discontinuous as viewed.

SUMMARY OF THE INVENTION

The present invention relates to a display device, poster, or portable blackboard formed of a thin plastic sheet stretched taut over a peripheral frame. The frame is comprised of a stiff core element, and a resilient deformable shell extending along and about the core element. The thin sheet of plastic is engaged on the frame so that during the sheet-attachment process the deformable shell is deformed inwardly toward the frame central axis, whereby the deformed shell exerts an outwardly directed reaction force on the sheet. The reaction force counteracts any tendency of the sheet to wrinkle, as under the effects of adverse conditions associated with temperature or humidity changes.

The present invention is particularly concerned with the frame construction and the manner of attachment of the associated plastic sheet.

DESCRIPTION OF A PREFERRED EMBODIMENT OF THE INVENTION

Figure 1:
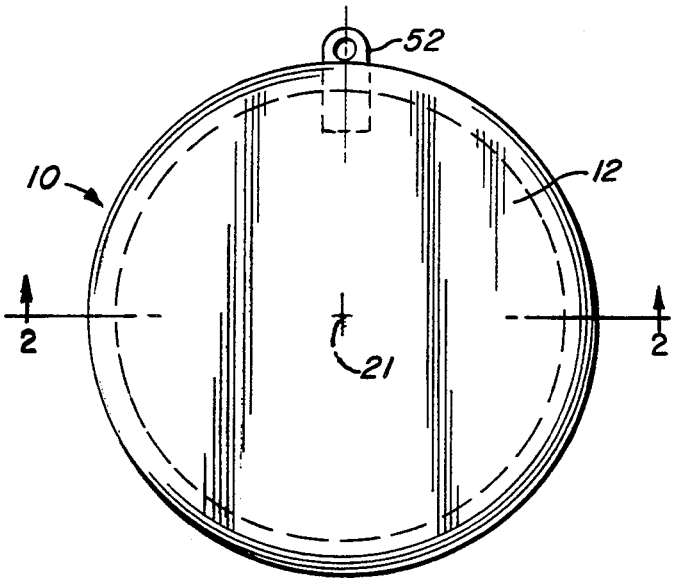
FIG. 1 is a plan view of a display device according to the present invention.
Figure 2:
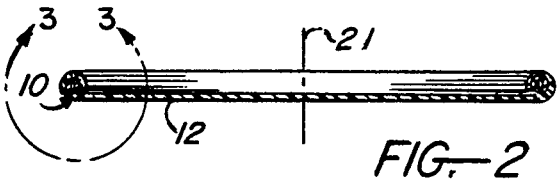
FIG. 2 is a sectional view taken at line 2—2 in FIG. 1.

Referring to FIGS. 1 and 2, a preferred embodiment of the invention is shown as comprising a circular poster or display device, including an annular hoop-like frame 10, and a thin plastic sheet 12 stretched taut across the frame.

Figure 3:
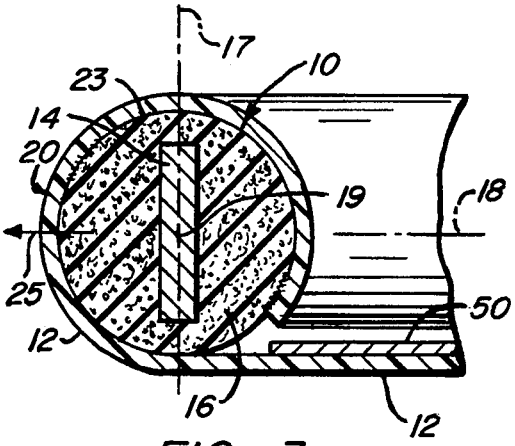
FIG. 3 is a fragmentary enlarged sectional view taken in the same direction as FIG. 2.

As best seen in FIGS. 2 and 3, frame 10 has first and second sides, and comprises a relatively stiff metal core element 14 encapsulated or encased in an annular sponge rubber or foam rubber or plastic body or sheath 16. Core element 14 is preferably formed of a strip of spring steel having its ends butt-welded together, whereby the core element assumes a circular annular configuration.

Core element 14 is rectangular in cross-section and is so oriented that the longer dimension of the rectangle is normal to the major plane 18 of the frame, so the core element has an outer side and edge portions. The resilient shell 16 has an annular outer surface 20, as viewed in FIG. 3. When the core element 14 is initially encapsulated within body 16, the longitudinal axis line 17 of the core element cross-section extends through the annular body cross-section center 19, as shown in FIG. 3. However, sheet 12 is engaged about the annular frame body surface, thereby compressing the foam rubber and deforming the shell toward the central axis 21 of the frame. As indicated in FIG. 3, the outer portion 23 of the annular foam rubber body cross-section is compressed by the sheet-attachment process, whereby the resilient rubber shell exerts on the sheet an outward reaction force, as indicated by arrow 25 in FIG. 3. This force 25 tends to maintain the plastic sheet in a taut condition and free of wrinkles or folds.

The annular foam rubber or plastic body provides the advantage of preventing the metal spring element 14 from cutting into or through the plastic sheet material.

Figure 5:
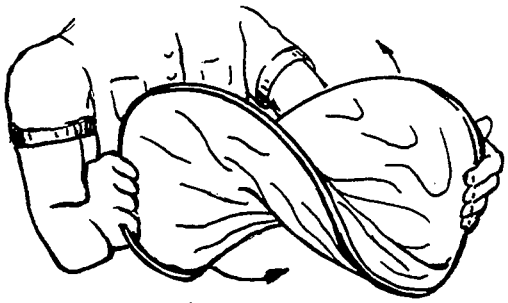
FIGS. 5 and 6 show different stages of manual folding of the device of FIG. 1 into a compacted configuration.
Figure 6:
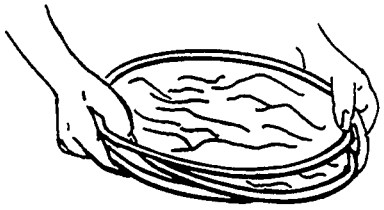
Figure 7:
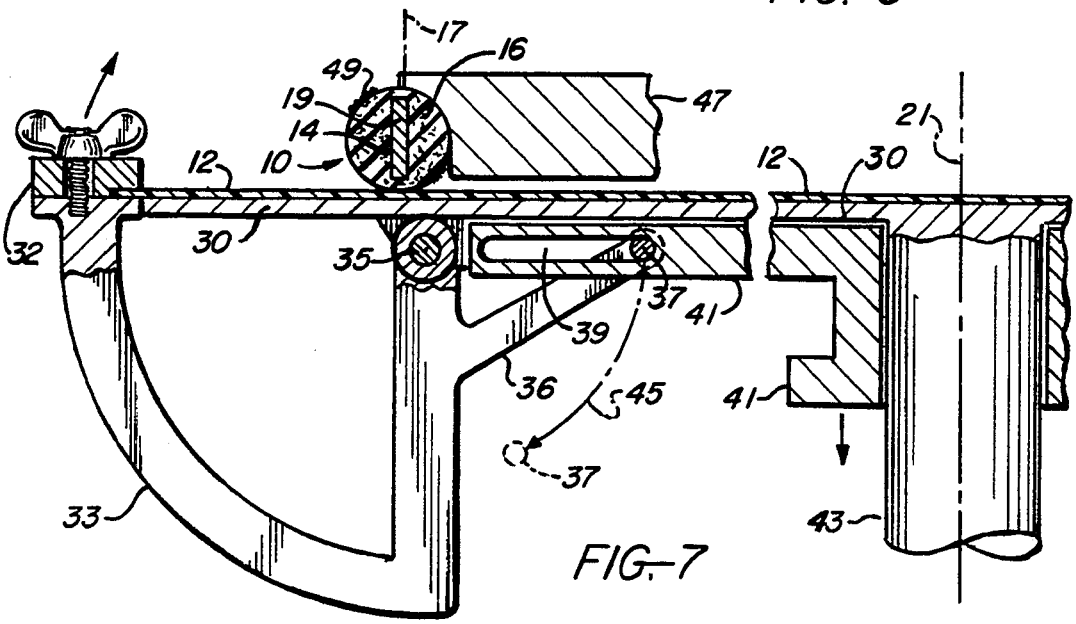
FIG. 7 is a fragmentary sectional view, partially in section, through an apparatus that may be utilized to attach a plastic sheet to an annular frame to form the display device of FIGS. 1 and 2.

As shown in FIGS. 5 and 6, the display device is manually foldable in the manner shown and described in the aforementioned U.S. Pat. No. 4,709,928, thus to provide a compact configuration for carrying and storage. After a substantial period of being in a folded configuration such as that of FIG. 6, within about ten minutes after being unfolded the plastic film becomes smooth and unwrinkled under the action of the foam rubber body or sheath 16.

Although plastic films are normally translucent or opaque to some degree, when printing of a dark contrasting color is applied to a light colored or transparent plastic sheet, the printed indicia often are visible through the plastic material, i.e., on the non-printed surface of the sheet. To avoid this undesirable condition, the plastic sheet may be laminated with a thin film of aluminum foil, as indicated at 50 in FIG. 3.

The display device of the invention may be effectively utilized as an erasable display or "blackboard" by utilizing plastic film bearing no indicia on at least some area on the side utilized for marking, with indicia on the reverse side of the plastic film not showing through to any substantial degree. Either permanent marking pens or non-permanent marking pens may be utilized. Non-permanent ink may b removed by wiping, and permanent marking pen ink may be removed with alcohol, water, etc., and wiping.

Figure 8:
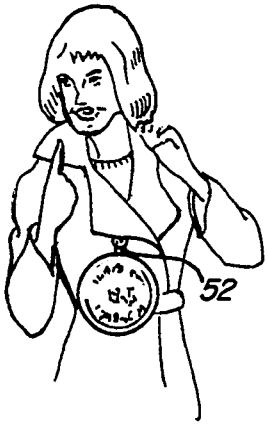
FIG. 8 is a perspective view showing the display device of FIG. 1 suspended from a button on the clothing of a person.
Figure 9:
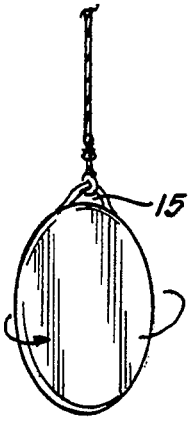
FIG. 9 shows a modified form of the display device of the invention having a handle engaging a cord for suspending the device.

An advantage provided by the invention is the capability of being suspended, as from a ceiling cord or from a person. By engagement of a cord in the opening of tab 52 (FIGS. 1 and 8) or with a handle on the display device (FIG. 9), the display device may be suspended by a cord from a ceiling, whereby the display device may rotate under the action of air movement, etc., to rotate in various directions for enhanced display. The display device may be suspended from a button on the garment of a person by engaging the button in the opening in tab 52 (FIG. 8). The display device of the invention thus provides substantial utility in promotional activities, political campaigns, etc., by enabling the freeing of the hands of a person for gesturing, waving, etc., while the display device displays appropriate indicia, legends, pictures, etc.

Poster and signs according to the invention may be constructed in various sizes and shapes. FIG. 5 illustrates a display device or poster of the invention of rectangular configuration, which is otherwise constructed like the frame of FIG. 3.

Figure 4:
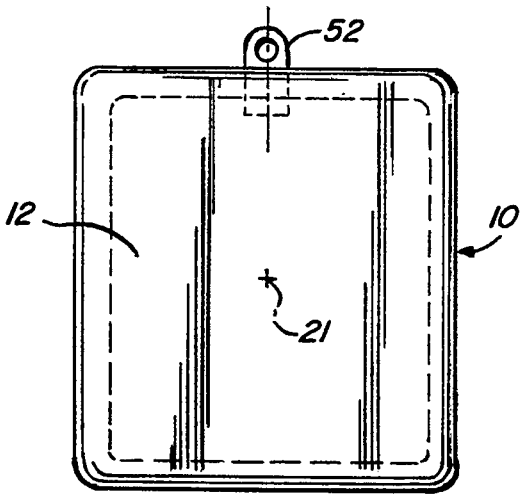
FIG. 4 is a plan view similar to that of FIG. 1, illustrating another embodiment of the invention of generally rectangular configuration.

Although various means and arrangements may be utilized for the purpose, FIG. 4 shows an apparatus which may be utilized to attach the flexible plastic sheet to frame 10. A stationary circular base plate 30 forms a supporting surface for the flat sheet. Edge areas of the sheet are pinched or clamped to a plurality of individual clamp devices 32, the number of which will vary depending on the diameter of the plastic sheet. Typically, twelve clamp devices 32 can be used.

Each clamp device is carried on an arm 33 that is swingably connected to the underside of base plate 30, as by means of a pivot connection 35. Each arm 33 has an extension 36 that mounts a pin 37 within a slot 39 in a slide structure 41. Downward motion of the slide structure 41 on the central shaft 43 causes each pin 37 to move in a downward arc 45, whereby the associated clamp devices 32 lift and curl the peripheral edge areas of plastic sheet 12 into contact with the curved outer surface of annular foam rubber shell 16.

Rubber or plastic foam sheath 16 may be temporarily held in a fixed position above plastic sheet 12 by means of a circular fixture 47. Prior to swingable movement of arms 33, a band of adhesive 49 may be placed on the outer surface of rubber shell 16, in certain embodiments of the invention. As clamp devices 32 move upwardly and arcuately around the associated pivots 35, if adhesive is utilized, the surface of plastic sheet 12 is brought into contact with adhesive band 49, thus to establish an annular connection between the sheet and the rubber shell.

Pivots 35 are located below the annular frame 10 so that, during upward arcuate movements of clamp devices 32, the plastic sheet 12 tends to be stretched outwardly as it comes into contact with different areas of the rubber shell surface. The sheet-stretching force translates into a compressing action on the outer half section 23 of rubber shell 16. Core 19 is sufficiently rigid to act as a fixed rigid support for rubber half section 23.

Afterward, the clamp device 32 are disengaged from the plastic sheet, and the sheet-frame 10 assembly is removed from fixture 47. The extreme outer edge of the plastic sheet is then curled about the shell 10 surface to provide the configuration depicted in FIG. 3.

FIG. 12 is preferably formed of nylon or other appropriate plastic material that is relatively stable dimensionally under temperature extremes. Experiments with polyester film indicate that it is subject to excessive shrinkage, and therefore is a non-preferred material.

Thus there has been shown and described a novel poster having a plastic sheet surface and a stressed frame which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart form the spirit and scope of the invention are deemed to be covered by the invention which is limited only by the claims which follow.

The inventor claims:

1. A display device comprising:

a peripheral frame having a relatively stiff core element, and having first and second sides, a resilient deformable sheath disposed completely about said core element and having an outer surface, a plastic sheet stretched on the frame and having outer portions thereof extending about the outer surface of the sheath, whereby tension forces in the sheet deform said resilient sheath in the direction inwardly of the frame, and thereby exert reaction forces to deform the sheath to prevent and eliminate wrinkling of the sheet.

2. A display device according to claim 1, wherein:

said sheet extends about the frame periphery and on both sides of the frame.

3. A display device according to claim 1, wherein the peripheral frame is generally curvilinear in configuration.

4. A display device according to claim 1, wherein the peripheral frame is rectangular in configuration.

5. A display device according to claim 1, wherein:

a first side of said plastic sheet has at least one area free of indicia, and the second side of the sheet bears no inidicia significantly visible on the first side of the sheet, whereby the display device is adapted for marking by erasable marking pens to provide an effective blackboard.

6. A display device according to claim 1, wherein:

the display device has thereon means defining an opening for attaching the device to support means.

7. A display device according to claim 6, wherein:

said means defining an opening comprises a tab extending outwardly from the periphery of the device and defining said opening.

8. A display device according to claim 1, wherein:

said plastic sheet has on one side thereof a film lamination, whereby indicia on the opposite side of the sheet are not visible through the plastic sheet.

9. A display device according to claim 8, wherein said film lamination is an aluminum film.

10. A display device according to claim 1, wherein said resilient sheath is formed of foam plastic.

11. A display device comprising:

a peripheral frame having a relatively stiff core element, and having first and second sides, a resilient deformable sheath disposed about said core element, said resilient sheath being formed of sponge rubber and having an outer surface;

a plastic sheet stretched on the frame and having outer portions thereof extending about said outer surface of the sheath, whereby tension forces in the sheet deform said resilient sheath in the direction inwardly of the frame, and thereby exert reaction forces to deform the sheath to prevent and eliminate wrinkling of the sheet.

12. A display device comprising:

a peripheral frame having a relatively stiff core element with an outer side and edge portions, said frame having first and second sides, a resilient deformable sheath disposed about at least the outer side of the said core element, said resilient sheath being formed of sponge rubber, a plastic sheet stretched on the frame and having outer portions thereof extending about an outer portion of the sheath to define the display device, tension forces in the sheet deforming said resilient sheath in the direction inwardly of the frame to exert reaction forces to deform the sheath to prevent and eliminate wrinkling of the sheet.

13. A display device comprising:

a peripheral frame having a relatively stiff core element with an outer side and edge portions, said frame having first and second sides, a resilient deformable sheath disposed about at least the outer side of the said core element, said resilient sheath being formed of foam plastic, a plastic sheet stretched on the frame and having outer portions thereof extending about an outer portion of the sheath to define the display device, tension forces in the sheet deforming said resilient sheath in the direction inwardly of the frame to exert reaction forces to deform the sheath to prevent and eliminate wrinkling of the sheet.

* * * * *